United States Patent [19]

Schroder

[11] 3,947,923

[45] Apr. 6, 1976

[54] FIBER CONDENSER

[75] Inventor: William John Schroder, Spartanburg, S.C.

[73] Assignee: Deering Milliken Research Corporation, Spartanburg, S.C.

[22] Filed: May 16, 1975

[21] Appl. No.: 578,267

[52] U.S. Cl. ..... 19/288

[51] Int. Cl.[2] ..... D01H 5/72

[58] Field of Search ..... 19/287–292, 19/157; 57/58.36, 58.83; 242/157 R

[56] References Cited

UNITED STATES PATENTS

| | | | |
|---|---|---|---|
| 3,874,033 | 4/1975 | Duncan | 19/288 |

FOREIGN PATENTS OR APPLICATIONS

| | | | |
|---|---|---|---|
| 9,140 | 1900 | United Kingdom | 19/287 |
| 21,042 | 1908 | United Kingdom | 19/288 |
| 28,503 | 1910 | United Kingdom | 19/287 |

*Primary Examiner*—Dorsey Newton

*Attorney, Agent, or Firm*—Earle R. Marden; H. William Petry

[57] ABSTRACT

An improved fiber condenser for a spinning frame which is designed to provide an area for the passage of roving which has an elongated opening therein to allow slubs, etc., to pass through without breaking the roving or stretching it.

1 Claim, 3 Drawing Figures

FIBER CONDENSER

Figures 1, 2, 3:
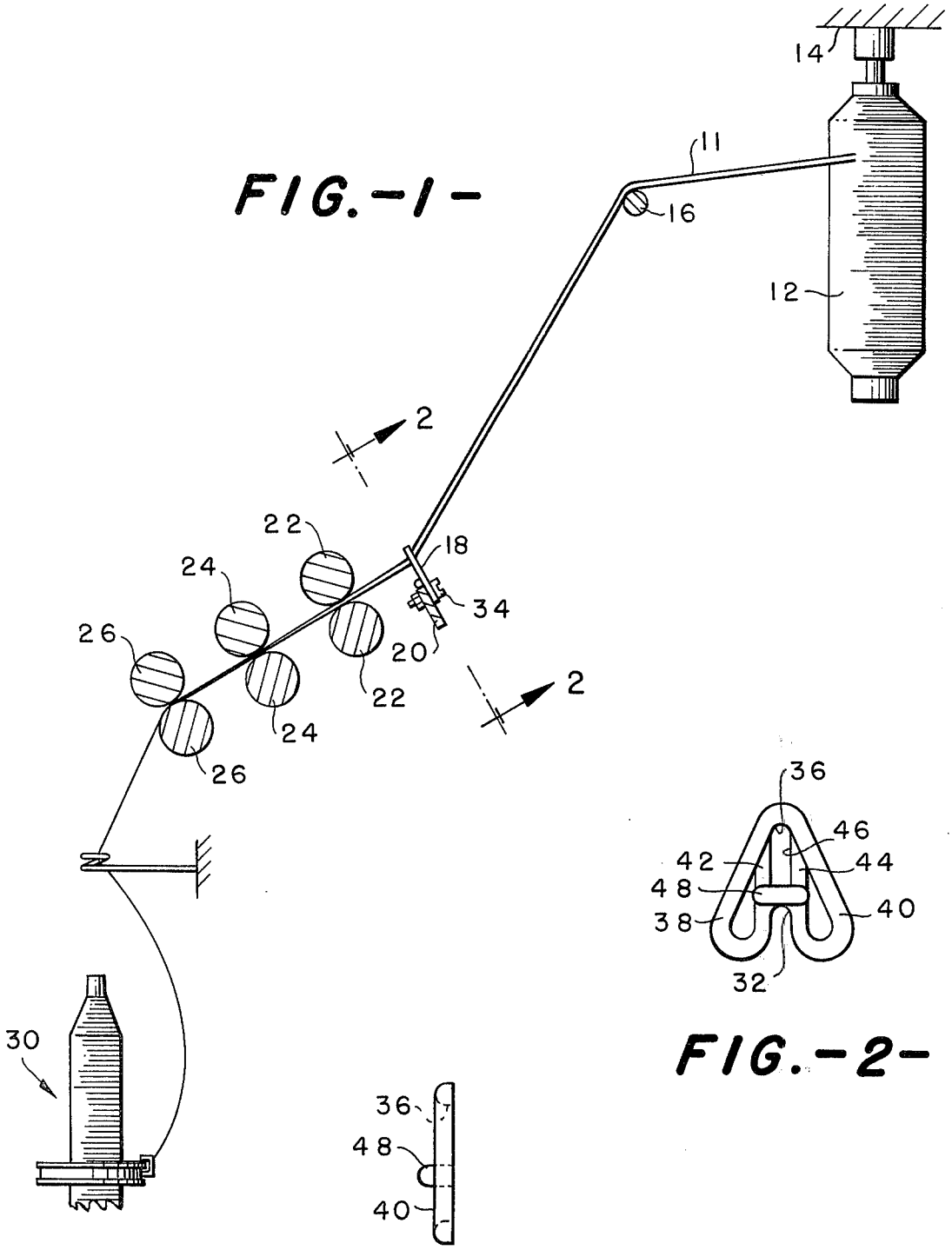

In customary practice, a strand of roving is led from a rotatably mounted spindle or "package", over a roving bar, and through a bell-shaped trumpet or fiber condenser disposed in correct position behind the drafting rolls of a spinning frame, the purpose of the trumpet being to locate the roving accurately and precisely with respect to the drafting rolls so that the roving will enter the bite of the rolls at the correct point and in a straight run.

The bell-shaped trumpets normally have a fixed size opening for the particular desired yarn and therefore, tends to break the roving when there is a slub, trash, etc., in the roving which will not pass through the trumpet opening. If it does not break it will partially stop up which will put stretch in the roving and this causes uneven yarn.

It is therefore an object of the invention to provide a trumpet which will allow roving which may have slubs, etc., therein to pass therethrough without breaking or stretching.

Other objects and advantages of the invention will become readily apparent as the specification proceeds to describe the invention with reference to the accompanying drawings, in which:

FIG. 1 is a schematic side elevation view of the principal elements of a spinning frame, FIG. 2 is a front view of the new and improved trumpet taken on line 2—2 of FIG. 1, and FIG. 3 is a side view of the improved trumpet shown in FIG. 2.

In FIG. 1 there is shown, diagrammatically, the essential elements of a spinning frame with which a trumpet constructed in accordance with the invention is particularly useful. A creel includes a frame or support 14 from which a number of rolls or packages of roving depend, such as package 12 of roving rotatably suspended from the frame 14. From the package 12 the roving 11 is led over a roving bar 16 and thence downwardly through the trumpet or fiber condenser 18 which is mounted on a transverse bar 20 disposed behind the drafting rolls. Customarily, three pairs of drafting rolls are employed, a pair of back rolls 22, a pair of middle rolls 24, and a pair of front rolls 26. The middle rolls 24 rotate faster than the back rolls 22, and the front rolls 26 rotate faster than the middle rolls 24; hence the fibers of the roving are drafted. The roving 11 after leaving the trumpet 18, proceeds through the drafting rolls along parallel paths until it leaves the bite of the front rolls 26. Then it enters the twisting system, indicated generally at 30, and then is twisted in customary fashion and wound on the spindle of the twisting system.

FIGS. 2 and 3 show the trumpet 18 in greater detail to illustrate the principles of the invention. The trumpet 18 is generally triangular in shape with an indented portion 32 to accommodate a bolt 34 which secures the trumpet to the traverse bar 20. In normal operation the roving 11 runs through the upper portion 36 of the trumpet but will move down in a lower position if a slub, lint, etc., is encountered by the trumpet. The trumpet is designed to allow the roving to seek its own position and to this end the sides 38 and 40 of the trumpet diverge outwardly in the down direction and curve around to form vertical walls 42 and 44, respectively to define the roving slot 46. A projection 48 is molded to the trumpet 18 to form an abutment surface and to guide stray roving away from the bolt 34.

In the preferred form of the invention the trumpet is substantially flat and is molded from a friction resistant plastic like material to provide a substantially frictionless surface for the roving to run over.

It is obvious that a trumpet is provided which will compensate for sudden increases in the roving diameter without breaking the roving and causing an ends down.

I have described the preferred embodiment of the invention but it should be understood that the invention is capable of alteration without departing from the spirit of the invention and therefore, I desire to be limited only by the claims.

That which is claimed is:

1. A roving guide for a spinning frame comprising: a generally flat unitary body member molded from a friction resistant plastic like material, said body member having two side walls diverging from an apex and a third wall interconnecting said diverging walls and having a portion thereof bowing upward to accommodate a screw, two substantially parallel walls spaced from one another and forming an opening therebetween connected at one end to said side walls adjacent the apex thereof and to said third wall at the other end and a projection on the face of said body member between the opening between said parallel walls and said third wall to guide roving away from the bowed portion of said third wall.

* * * * *